US011398687B2

(12) United States Patent
Hashiguchi

(10) Patent No.: US 11,398,687 B2
(45) Date of Patent: Jul. 26, 2022

(54) CABLE ASSEMBLY AND STRUCTURE

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/088,781

(22) Filed: Nov. 4, 2020

(65) Prior Publication Data

US 2021/0226354 A1 Jul. 22, 2021

(30) Foreign Application Priority Data

Jan. 17, 2020 (JP) ..... JP2020-005551

(51) Int. Cl.

| | |
|---|---|
| ***H01R 9/05*** | (2006.01) |
| ***H01R 4/18*** | (2006.01) |
| *H01R 103/00* | (2006.01) |
| *H01R 4/10* | (2006.01) |
| *H01R 12/69* | (2011.01) |
| *H01R 13/58* | (2006.01) |
| *H01R 12/53* | (2011.01) |

(Continued)

(52) U.S. Cl.

CPC ..... *H01R 9/0518* (2013.01); *H01R 4/18* (2013.01); *H01R 9/0515* (2013.01); *H01R 4/10* (2013.01); *H01R 12/53* (2013.01); *H01R 12/57* (2013.01); *H01R 12/69* (2013.01); *H01R 13/5808* (2013.01); *H01R 13/6594* (2013.01); *H01R 2103/00* (2013.01)

(58) Field of Classification Search

CPC ..... H01R 9/0518; H01R 4/18; H01R 9/0515; H01R 4/10; H01R 12/69; H01R 13/5808; H01R 2103/00; H01R 12/57; H01R 13/6594; H01R 12/53

See application file for complete search history.

(56) References Cited

U.S. PATENT DOCUMENTS

| | | | | |
|---|---|---|---|---|
| 5,716,236 | A | 2/1998 | O'Sullivan et al. | |
| 8,872,726 | B2 | 10/2014 | Kusanagi | |
| 2013/0224996 | A1 * | 8/2013 | Miyawaki | H01R 9/05 439/585 |

FOREIGN PATENT DOCUMENTS

| | | | | |
|---|---|---|---|---|
| CN | 104160558 | A * | 11/2014 | H01R 12/53 |
| JP | S60-009166 | U | 1/1985 | |
| JP | H09-245899 | A | 9/1997 | |

(Continued)

*Primary Examiner* — Abdullah A Riyami
*Assistant Examiner* — Justin M Kratt
(74) *Attorney, Agent, or Firm* — Collard & Roe, P.C.

(57) ABSTRACT

A cable assembly comprises a cable and a conductive member. The cable extends in a longitudinal direction. The cable has a first location and a second location in the longitudinal direction. The cable comprises a conductive portion and an outer cover. The outer cover covers the conductive portion. The conductive member is attached with the cable. The conductive member has a first portion, a second portion and a planar portion. The first portion is positioned at the first location in the longitudinal direction. The first portion is crimped to the outer cover. The second portion is positioned at the second location in the longitudinal direction. The second portion is crimped to the conductive portion. The planar portion extends from the first location to the second location in the longitudinal direction.

5 Claims, 12 Drawing Sheets

(51) Int. Cl.
*H01R 12/57* (2011.01)
*H01R 13/6594* (2011.01)

(56) References Cited

FOREIGN PATENT DOCUMENTS

| | | | |
|---|---|---|---|
| JP | 2011-019178 | A | 1/2011 |
| JP | 2015-103510 | A | 6/2015 |

* cited by examiner

CABLE ASSEMBLY AND STRUCTURE

CROSS REFERENCE TO RELATED APPLICATIONS

This application is based on and claims priority under 35 U.S.C. § 119 to Japanese Patent Application No. JP2020-005551 filed Jan. 17, 2020, the contents of which are incorporated herein in their entirety by reference.

BACKGROUND OF THE INVENTION

This invention relates to a cable assembly comprising a cable and a conductive member.

As shown in FIG. 23, a cable assembly 900 of FIG. 6 of JPA2015-103510 (Patent Document 1) comprises a cable 950 and a conductive member 910. The cable 950 comprises a conductive portion 954 and an outer cover 955 which covers the conductive portion 954. The conductive member 910 has a first portion 914, a second portion 915 and a coupling portion 918. The first portion 914 is crimped to the outer cover 955. The second portion 915 is crimped to the conductive portion 954.

If a cable assembly such as the cable assembly 900 of Patent Document 1 is fixed on a fixing portion of a circuit board or the like by soldering or the like, the cable assembly might be removed from the circuit board upon the cable 950 being swung.

SUMMARY OF THE INVENTION

It is therefore an object of the present invention to provide a cable assembly having a configuration which is securely fixed on a circuit board or the like. In addition, it is another object of the present invention to provide a structure which comprises the above-mentioned cable assembly.

One aspect (first aspect) of the present invention provides a cable assembly comprising a cable and a conductive member. The cable extends in a longitudinal direction. The cable has a first location and a second location in the longitudinal direction. The cable comprises a conductive portion and an outer cover. The outer cover covers the conductive portion. The conductive member is attached with the cable. The conductive member has a first portion, a second portion and a planar portion. The first portion is positioned at the first location in the longitudinal direction. The first portion is crimped to the outer cover. The second portion is positioned at the second location in the longitudinal direction. The second portion is crimped to the conductive portion. The planar portion extends from the first location to the second location in the longitudinal direction.

Another aspect (second aspect) of the present invention provides a structure comprising a circuit board and the cable assembly of the first aspect. The circuit board has a fixing portion. The planar portion is fixed on the fixing portion.

The cable assembly of the present invention is configured as follows: the conductive member has the planar portion; and the planar portion extends from the first location to the second location in the longitudinal direction in which the cable extends. Thus, the cable assembly of the present invention is configured so that not only the conductive portion of the cable but also the outer cover thereof are securely fixed on a circuit board or the like, via the conductive member, by fixing the planar portion on a fixing portion of the circuit board or the like. In other words, the cable assembly of the present invention has a configuration which is securely fixed on a circuit board or the like.

An appreciation of the objectives of the present invention and a more complete understanding of its structure may be had by studying the following description of the preferred embodiment and by referring to the accompanying drawings.

Figure 1:
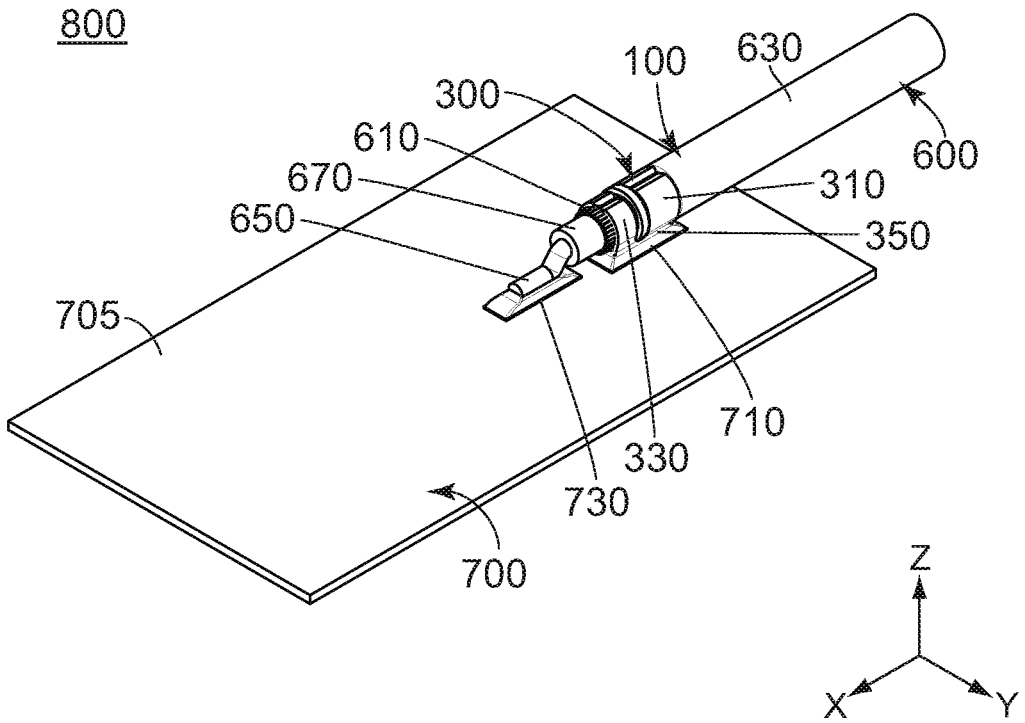
FIG. 1 is a perspective view showing a structure according to a first embodiment of the present invention. In the figure, a planar portion of a cable assembly is soldered on a fixing portion of a circuit board while a core wire of the cable assembly is soldered on a pad of the circuit board.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIG. 1, a structure 800 according to a first embodiment of the present invention comprises a circuit board 700 and a cable assembly 100.

Figure 2:
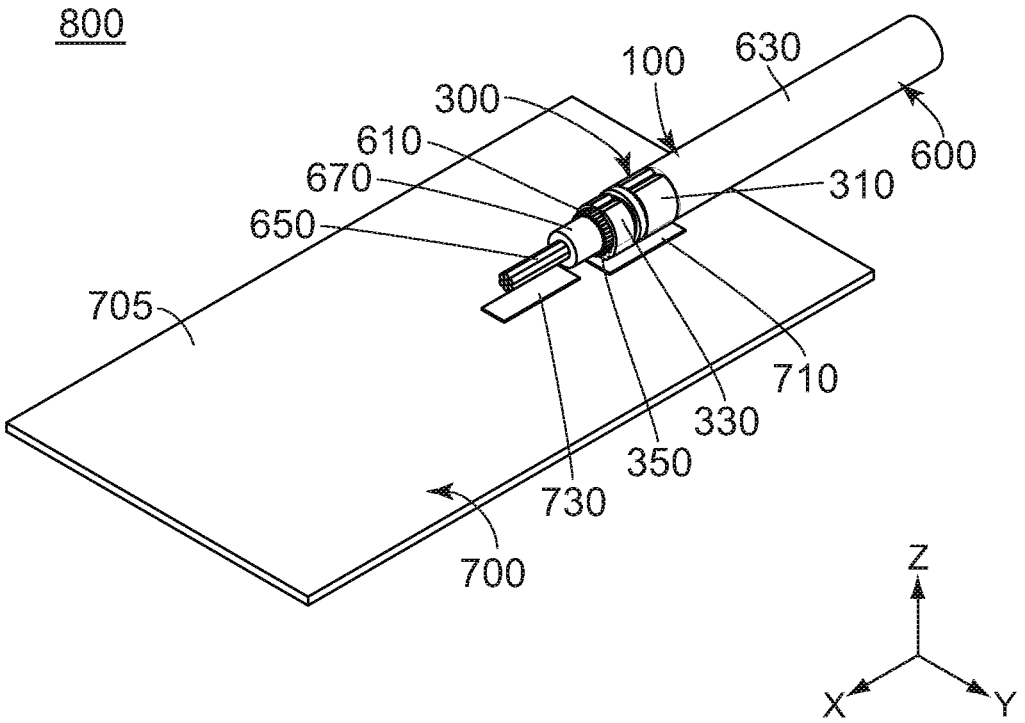
FIG. 2 is another perspective view showing the structure of FIG. 1. In the figure, the planar portion is not soldered on the fixing portion of the circuit board while the core wire is not soldered on the pad of the circuit board.

As shown in FIGS. 1 and 2, the circuit board 700 of the present embodiment has a fixing portion 710 and a pad 730. Each of the fixing portion 710 and the pad 730 is provided on an upper surface 705 of the circuit board 700. In the present embodiment, an up-down direction is a Z-direction. Specifically, upward is a positive Z-direction while downward is a negative Z-direction.

Figure 3:
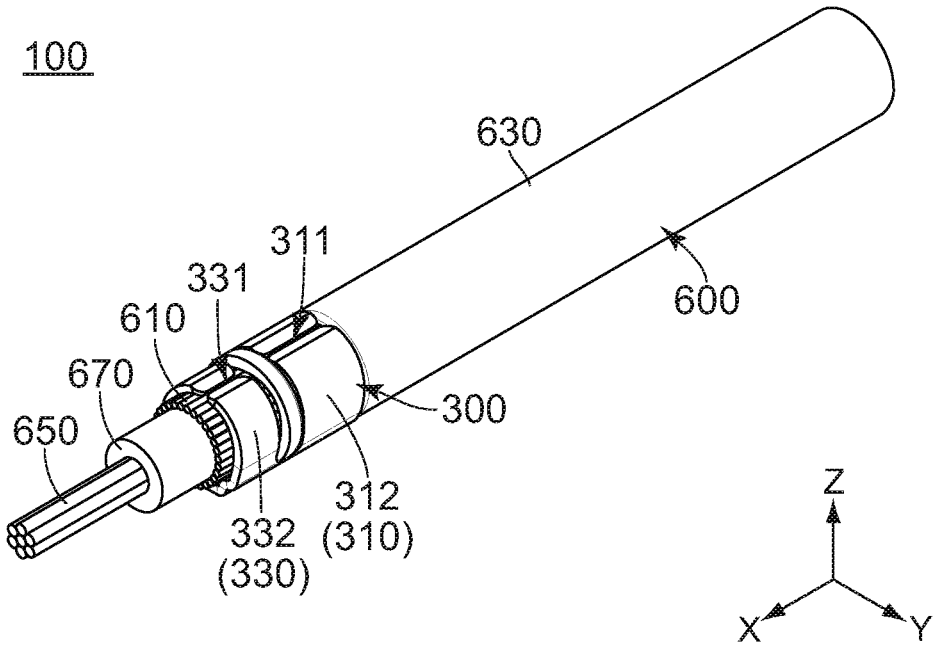
FIG. 3 is a perspective view showing the cable assembly which is included in the structure of FIG. 1.

As shown in FIG. 3, the cable assembly 100 of the present embodiment comprises a cable 600 and a conductive member 300.

As shown in FIG. 3, the cable 600 of the present embodiment comprises a conductive portion 610, or an outer conductor 610, and an outer cover 630. The outer cover 630 covers the conductive portion 610. In detail, the cable 600 is a coaxial cable. Specifically, the cable 600 has the outer cover 630, the conductive portion 610, or the outer conductor 610, an insulator 670 and a core wire 650. However, the present invention is not limited thereto. The cable 600 may be a cable other than a coaxial cable. Specifically, the cable 600 may be, for example, a shielded cable which is shielded by metallic foil or the like. In addition, the cable 600 may be a single cable. In other words, the conductive portion 610 may not be the outer conductor, but may be a core wire.

Figure 5:
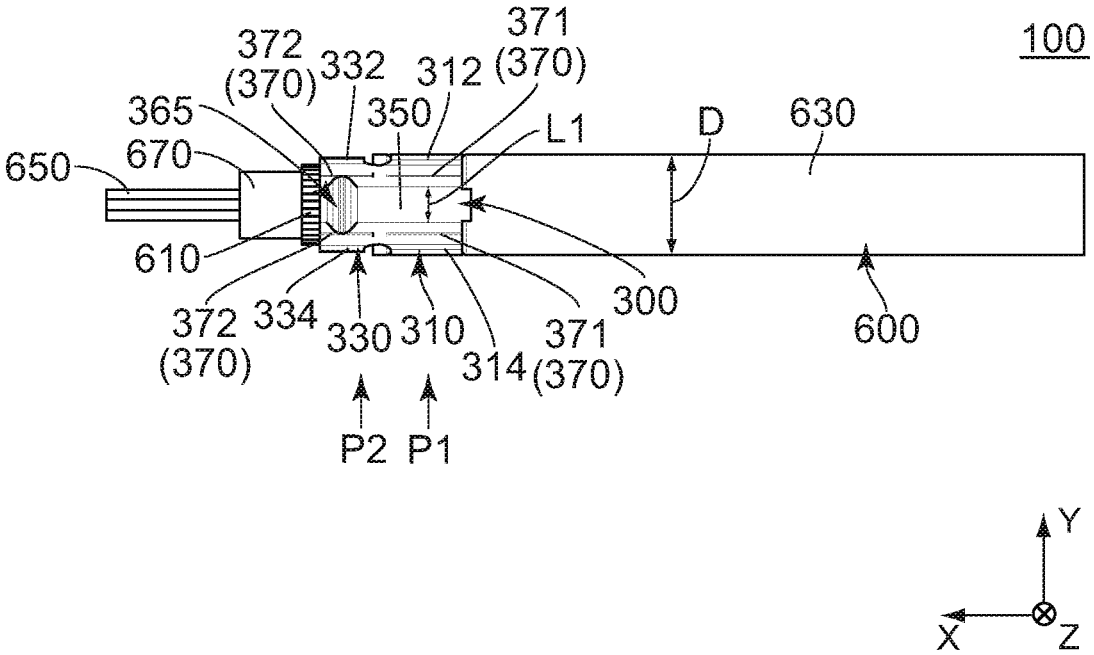
FIG. 5 is a bottom view showing the cable assembly of FIG. 3.
Figure 6:
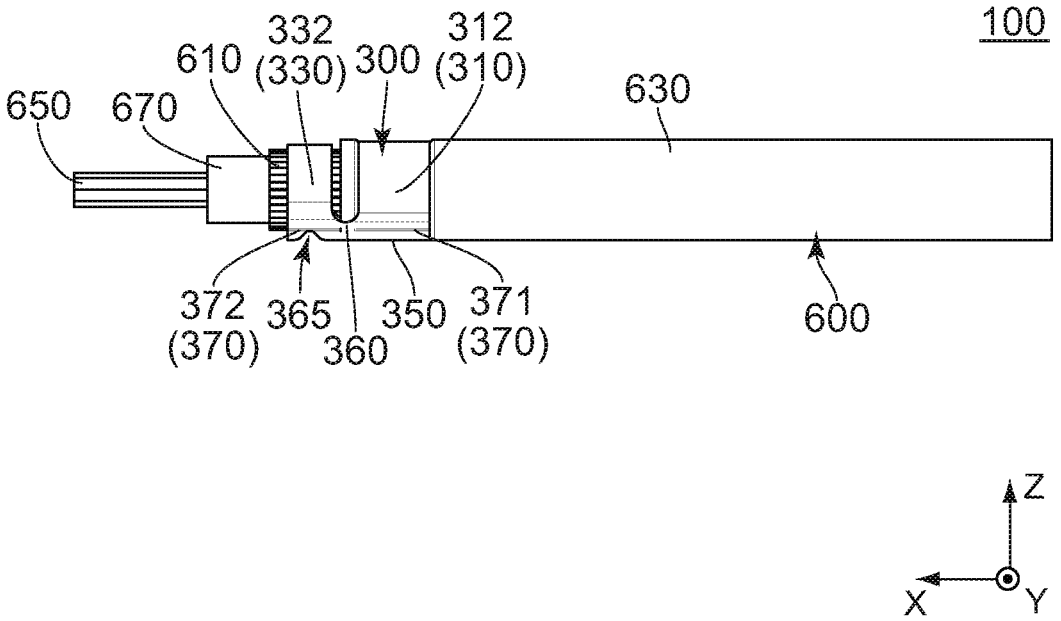
FIG. 6 is a side view showing the cable assembly of FIG. 3.
Figure 7:
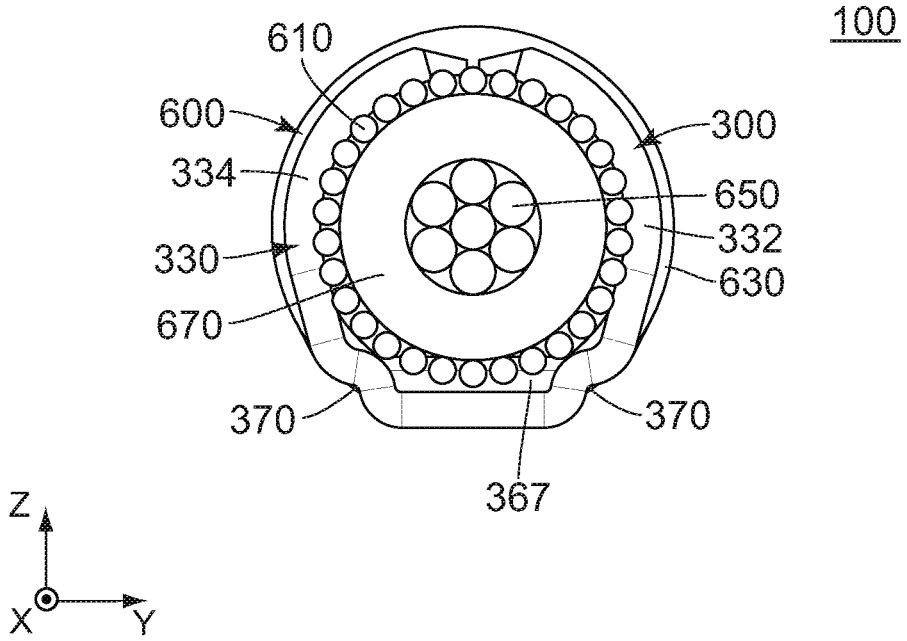
FIG. 7 is a front view showing the cable assembly of FIG. 3.

As shown in FIG. 3, the conductive member 300 of the present embodiment is attached with the cable 600. As shown in FIGS. 5 to 7, the conductive member 300 has a first portion 310, a second portion 330, a planar portion 350, a coupling portion 360, a hollow portion 365, a bulge portion 367 and four ditches 370.

Figure 4:
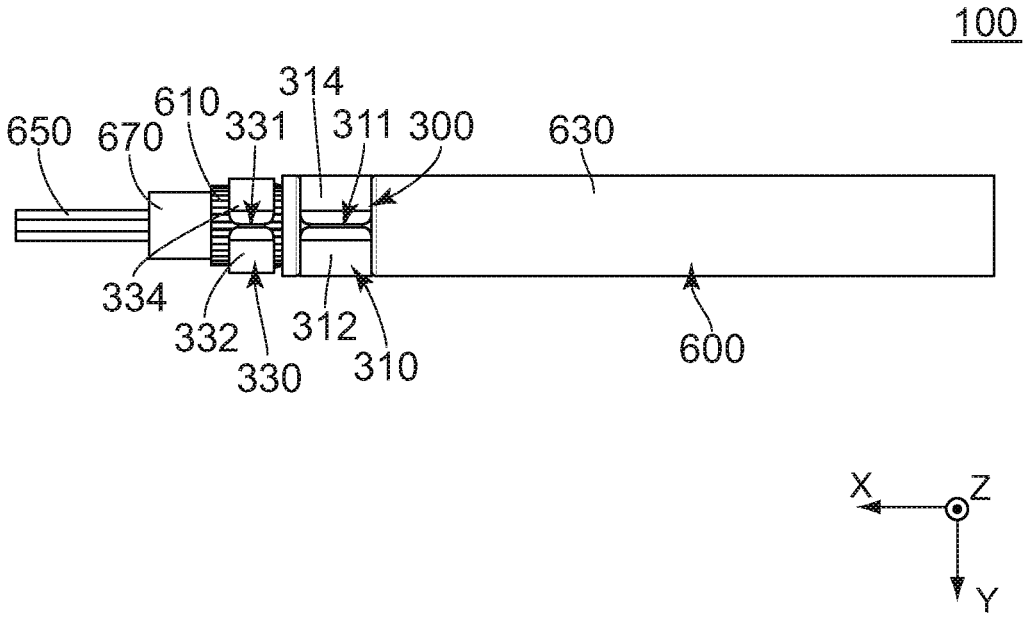
FIG. 4 is a top view showing the cable assembly of FIG. 3.

As shown in FIG. 4, the first portion 310 of the present embodiment has an open barrel shape. In other words, the first portion 310 has a first opening 311 which is positioned at an upper side thereof in the up-down direction. The first portion 310 is crimped to the outer cover 630. As shown in FIG. 5, the first portion 310 is positioned at a first location P1 of the cable 600 in a longitudinal direction. In the present embodiment, the longitudinal direction is an X-direction. In addition, the longitudinal direction is also referred to as a front-rear direction. Specifically, it is assumed that forward is a positive X-direction while rearward is a negative X-direction. The first portion 310 has a first right crimp portion 312 and a first left crimp portion 314. The first right crimp portion 312 and the first left crimp portion 314 are positioned at opposite sides, respectively, of the planar portion 350 in a width direction perpendicular to the longitudinal direction. The first right crimp portion 312 is positioned rightward of the first left crimp portion 314 in the width direction. In the present embodiment, the width direction is a Y-direction. Specifically, rightward is a positive Y-direction while leftward is a negative Y-direction.

As shown in FIG. 4, the second portion 330 of the present embodiment has an open barrel shape. In other words, the second portion 330 has a second opening 331 which is positioned at an upper side thereof in the up-down direction. The second portion 330 is crimped to the conductive portion 610. As shown in FIG. 5, the second portion 330 is positioned at a second location P2 of the cable 600 in the longitudinal direction. The second portion 330 has a second right crimp portion 332 and a second left crimp portion 334. The second right crimp portion 332 and the second left crimp portion 334 are positioned at the opposite sides, respectively, of the planar portion 350 in the width direction. The second right crimp portion 332 and the second left crimp portion 334 are positioned at opposite sides, respectively, of the hollow portion 365 in the width direction. The second right crimp portion 332 is positioned rightward of the second left crimp portion 334 in the width direction.

As understood from FIGS. 5 and 6, the planar portion 350 of the present embodiment is a plane perpendicular to the up-down direction. The planar portion 350 defines a lower end of the conductive member 300. The planar portion 350 extends from the first location P1 to the second location P2 in the longitudinal direction. A part of the planar portion 350 is positioned at a position same as a position of the first portion 310 in the front-rear direction. Another part of the planar portion 350 is positioned at a position same as a position of the second portion 330 in the front-rear direction. In the front-rear direction, a rear end of the planar portion 350 is positioned rearward beyond a rear end of the first portion 310.

As shown in FIG. 1, the planar portion 350 of the present embodiment is fixed on the fixing portion 710. Specifically, the planar portion 350 is fixed on the fixing portion 710 by soldering or the like. However, a method of fixing the planar portion 350 thereon is not limited to soldering. The planar portion 350 may be fixed thereon by laser welding or ultrasonic welding. In order to fix the cable assembly 100 of the present embodiment on the fixing portion 710 of the circuit board 700, the cable assembly 100 is placed on the circuit board 700 so that the planar portion 350 and the fixing portion 710 are brought into surface contact with each other. Upon placing, the cable assembly 100 never rolls on the circuit board 700. Specifically, the cable assembly 100 is prevented from being misaligned with respect to the fixing portion 710 if the cable assembly 100 is placed on the circuit board 700 so that the planar portion 350 and the fixing portion 710 are brought into surface contact with each other. In other words, the cable assembly 100 of the present embodiment has a configuration that is easy to be handled when the cable assembly 100 is fixed on the circuit board 700. As described above, the planar portion 350 of the present embodiment extends from the first location P1, where the first portion 310 is positioned, to the second location P2, where the second portion 330 is positioned, in the longitudinal direction. Thus, not only the conductive portion 610 of the cable 600 but also the outer cover 630 thereof are securely fixed on the circuit board 700 via the conductive member 300 when the planar portion 350 is fixed on the fixing portion 710. This prevents removal of the planar portion 350 of the conductive member 300 from the fixing portion 710 of the circuit board 700 even if the cable 600 of the structure 800 is swung.

Referring to FIG. 5, the planar portion 350 has a size L1 at the first location P1 in the width direction perpendicular to the longitudinal direction, and the size L1 of the planar portion 350 is one tenth of a diameter D of the cable 600 or more. This enables the cable assembly 100 to be placed stably on the circuit board 700 when the cable assembly 100 is placed on the circuit board 700 so that the planar portion 350 and the fixing portion 710 are brought into surface contact with each other.

As shown in FIG. 6, the coupling portion 360 of the present embodiment is positioned between the first portion 310 and the second portion 330 in the front-rear direction. The coupling portion 360 couples the first portion 310 and the second portion 330 with each other in the front-rear direction.

As shown in FIG. 6, the hollow portion 365 of the present embodiment is recessed upward in the up-down direction. The hollow portion 365 is positioned around a front end of the conductive member 300 in the front-rear direction. The hollow portion 365 is positioned below the second portion 330 in the up-down direction. The hollow portion 365 is positioned at a position same as a position of the second portion 330 in the front-rear direction.

Referring to FIG. 7, the bulge portion 367 of the present embodiment is bulged upward in the up-down direction perpendicular to the longitudinal direction. The bulge portion 367 is positioned around the front end of the conductive member 300 in the front-rear direction. The bulge portion 367 is positioned at a position same as the position of the second portion 330 in the longitudinal direction, or in the front-rear direction. An upper end of the bulge portion 367 is positioned above the ditch 370 in the up-down direction. The bulge portion 367 is positioned at the position same as the position of the hollow portion 365 as shown in FIG. 6 in the front-rear direction. The bulge portion 367 is brought into contact with the conductive portion 610 of the cable 600. Specifically, the bulge portion 367 is brought into contact with the conductive portion 610 from below in the up-down direction. As described above, the conductive member 300 of the present embodiment has the bulge portion 367. Thus, even if a vertical gap of a certain size is left between a surface of the outer cover 630 and the conductive portion 610 due to a thickness of the outer cover 630, the conductive member 300 and the conductive portion 610 can be securely connected with each other via the bulge portion 367 upon attaching of the conductive member 300 with the cable 600.

As shown in FIG. 5, the ditches 370 of the present embodiment include two first ditches 371 and two second ditches 372.

As shown in FIG. 5, the first ditch 371 of the present embodiment is positioned rearward of the second ditch 372 in the front-rear direction. Each of the first ditches 371 extends in the longitudinal direction. The two first ditches 371 are arranged in the width direction. The first ditch 371 is positioned between the first portion 310 and the planar portion 350. More specifically, the first ditch 371, which is positioned rightward of the planar portion 350, is positioned between the first right crimp portion 312 and the planar portion 350. In addition, the first ditch 371, which is positioned leftward of the planar portion 350, is positioned between the first left crimp portion 314 and the planar portion 350. In the width direction, the first right crimp portion 312 is positioned rightward of the first ditch 371 which is positioned rightward of the planar portion 350. In the width direction, the first left crimp portion 314 is positioned leftward of the first ditch 371 which is positioned leftward of the planar portion 350.

As shown in FIG. 5, the second ditch 372 of the present embodiment is positioned forward of the first ditch 371 in the front-rear direction. Each of the second ditches 372 extends in the longitudinal direction. The two second ditches 372 are arranged in the width direction. The second ditch 372 is positioned between the second portion 330 and the planar portion 350. More specifically, the second ditch 372, which is positioned rightward of the planar portion 350, is positioned between the second right crimp portion 332 and the planar portion 350. In addition, the second ditch 372, which is positioned leftward of the planar portion 350, is positioned between the second left crimp portion 334 and the planar portion 350. In the width direction, the second right crimp portion 332 is positioned rightward of the second ditch 372 which is positioned rightward of the planar portion 350. In the width direction, the second left crimp portion 334 is positioned leftward of the second ditch 372 which is positioned leftward of the planar portion 350.

Hereinafter, description will be made in detail about one example of a method of manufacturing the cable assembly 100.

Figure 10:
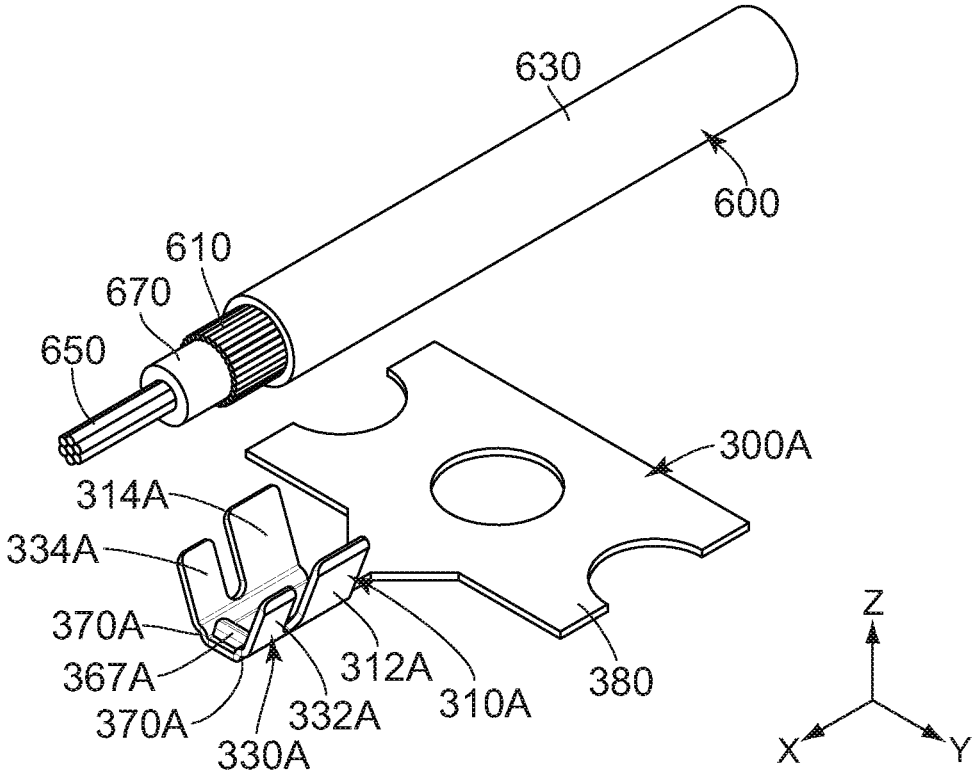
FIG. 10 is yet another perspective view for explaining the manufacturing process of the cable assembly of FIG. 3. In the figure, the conductive member is coupled with the carrier and is separated from the cable.
Figure 11:
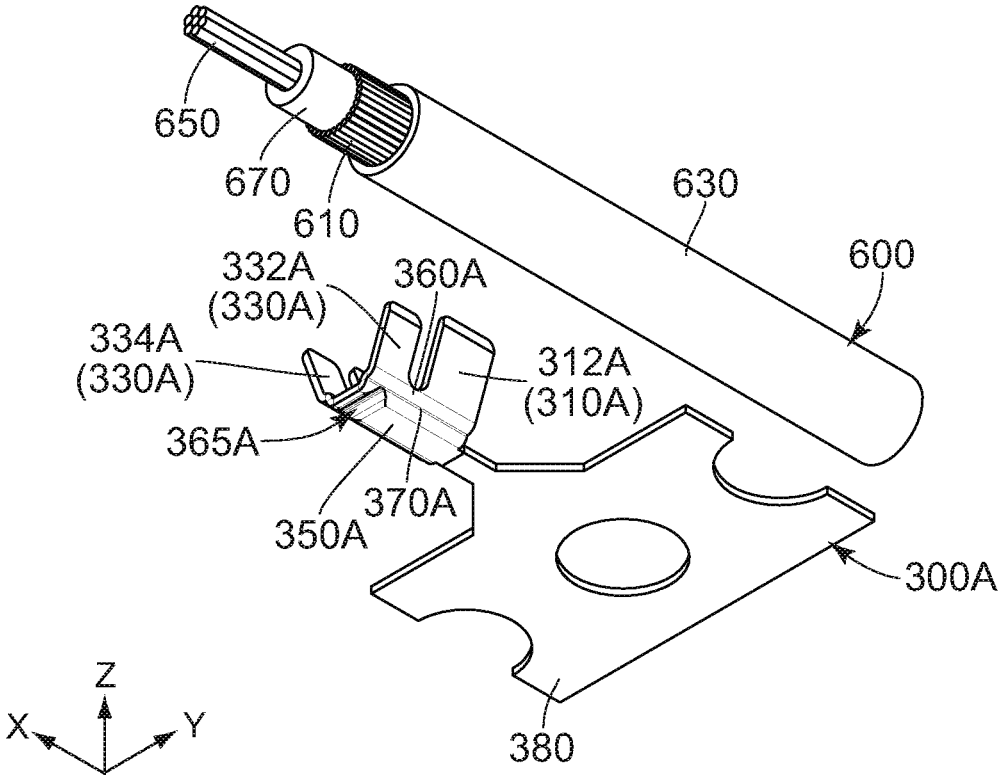
FIG. 11 is another perspective view showing the cable assembly of FIG. 10.

Referring to FIGS. 10 and 11, a conductive member intermediary body 300A is first formed by punching out a single metal plate, followed by bending it. The conductive member intermediary body 300A has a first portion 310A, a second portion 330A, a planar portion 350A, a coupling portion 360A, a hollow portion 365A and a bulge portion 367A. The first portion 310A has a first right crimp portion 312A and a first left crimp portion 314A. The second portion 330A has a second right crimp portion 332A and a second left crimp portion 334A. In addition, the conductive member intermediary body 300A has two ditches 370A each extending in the longitudinal direction. In other words, under a state where the conductive member 300 is not attached with the cable 600, the conductive member 300 has the two ditches 370A each extending in the longitudinal direction. The two ditches 370A are arranged in the width direction. Each of the ditches 370A is positioned between the first portion 310A and the planar portion 350A. Each of the ditches 370A is positioned between the second portion 330A and the planar portion 350A. More specifically, the ditch 370A, which is positioned rightward of the planar portion 350A, is positioned between the first right crimp portion 312A and the planar portion 350A. The ditch 370A positioned rightward of the planar portion 350A is positioned between the second right crimp portion 332A and the planar portion 350A. Similarly, the ditch 370A, which is positioned leftward of the planar portion 350A, is positioned between the first left crimp portion 314A and the planar portion 350A. The ditch 370A positioned leftward of the planar portion 350A is positioned between the second left crimp portion 334A and the planar portion 350A.

Figure 12:
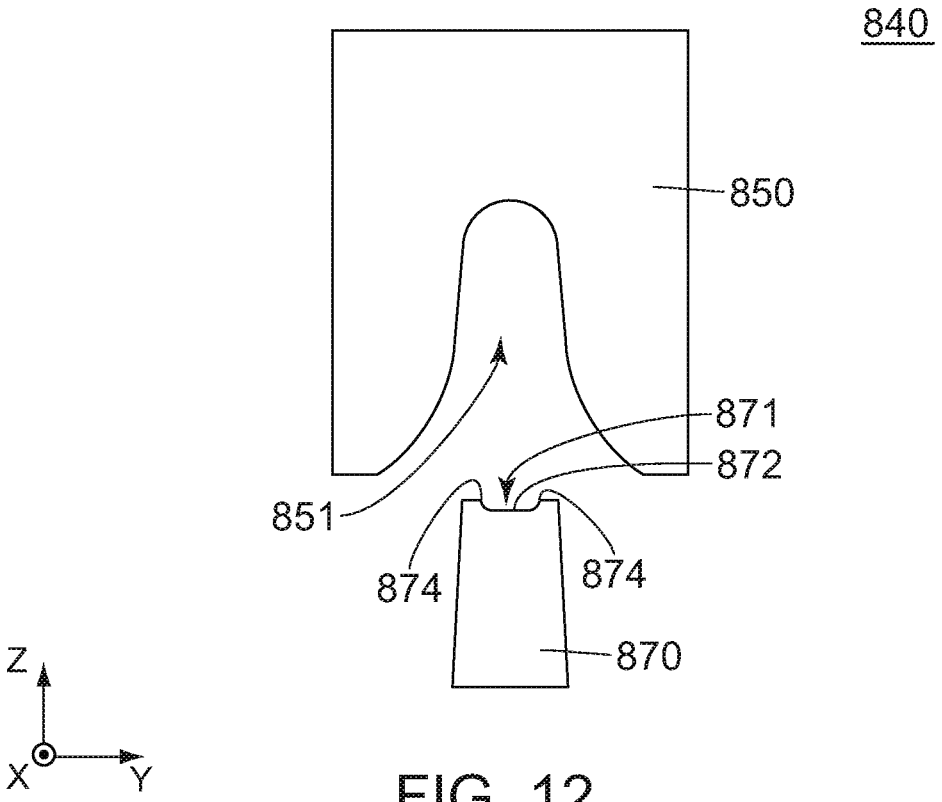
FIG. 12 is a front view showing a crimping metal die which is used for manufacturing the cable assembly of FIG. 3.

Next, a crimping metal die 840 shown in FIG. 12 is prepared. The crimping metal die 840 consists of an upper crimping metal die 850 and a lower crimping metal die 870. The upper crimping metal die 850 has a first recess 851 which is recessed upward in the up-down direction. The lower crimping metal die 870 has a second recess 871 which is recessed downward in the up-down direction. The second recess 871 has a planar portion mounting portion 872 and two protruding portions 874. The planar portion mounting portion 872 defines a lower end of the second recess 871 in the up-down direction. The planar portion mounting portion 872 is a plane perpendicular to the up-down direction. The protruding portions 874 are positioned at opposite ends, respectively, of the second recess 871 in the width direction.

After that, the conductive member intermediary body 300A is placed on the lower crimping metal die 870 of the crimping metal die 840 so that the planar portion 350A of the conductive member intermediary body 300A faces the planar portion mounting portion 872 of the lower crimping metal die 870 in the up-down direction. At this time, the planar portion 350A of the conductive member intermediary body 300A is brought into surface contact with the planar portion mounting portion 872 of the lower crimping metal die 870. The planar portion 350A prevents the conductive member intermediary body 300A of the present embodiment from rolling out of the second recess 871 of the lower crimping metal die 870 when the conductive member intermediary body 300A is placed on the lower crimping metal die 870. Also, at this time, the protruding portions 874 of the lower crimping metal die 870 are engaged with the ditches 370A, respectively, of the conductive member intermediary body 300A. The ditches 370A regulate an outward movement of the conductive member intermediary body 300A of the present embodiment beyond the second recess 871 when the conductive member intermediary body 300A is placed on the lower crimping metal die 870.

Figure 9:
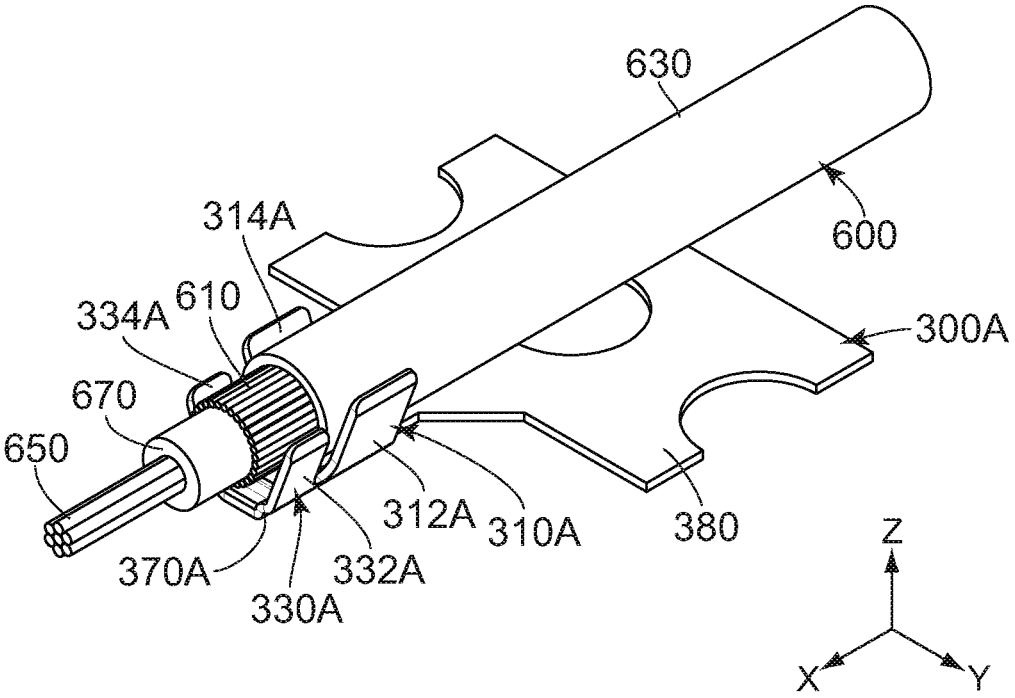
FIG. 9 is another perspective view for explaining the manufacturing process of the cable assembly of FIG. 3. In the figure, the conductive member is coupled with the carrier and is not attached with the cable.

After that, the outer cover 630 and the insulator 670 are partially peeled away from the cable 600 so that the conductive portion 610 and the core wire 650 are partially exposed to the outside of the cable 600, and the peeled cable 600 is arranged, as shown in FIG. 9, relative to the conductive member intermediary body 300A. In this state, the first portion 310A is positioned at a position same as a position of a part of the outer cover 630 in the front-rear direction. Also, in this state, the second portion 330A is positioned at a position same as a position of a part of the conductive portion 610 in the front-rear direction. Further, in this state, the upper crimping metal die 850 is positioned just above the conductive member intermediary body 300A.

Figure 13:
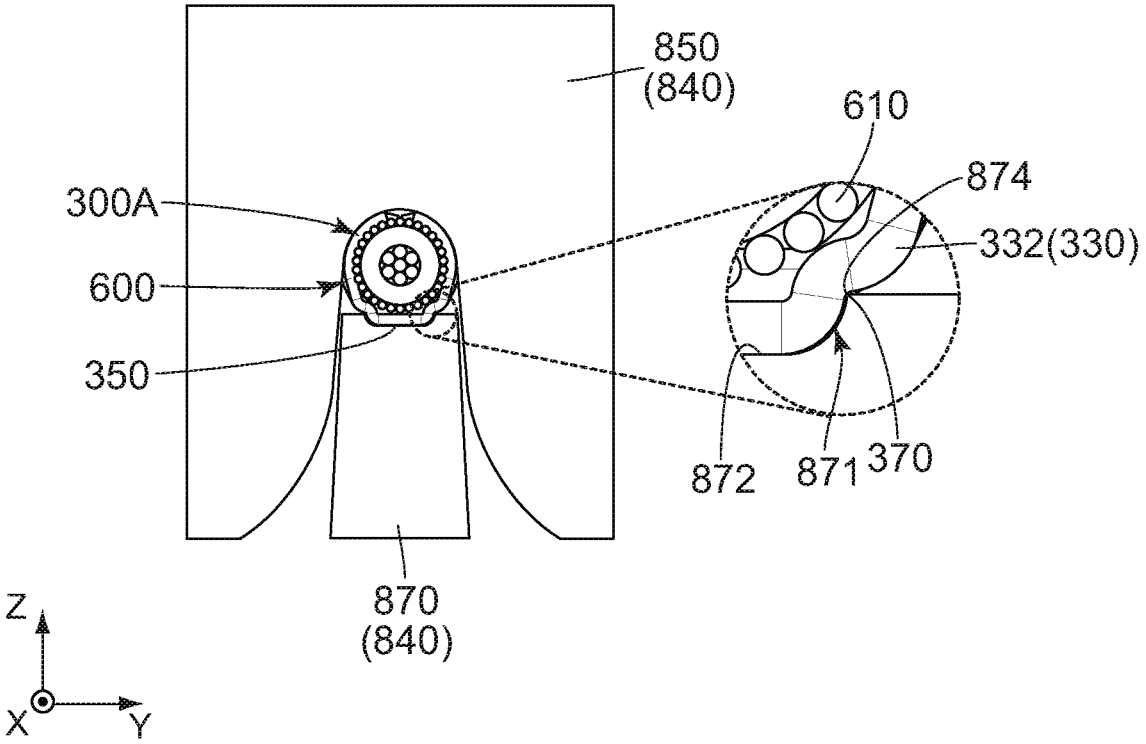
FIG. 13 is a front view for explaining the manufacturing process of the cable assembly of FIG. 3. In the figure, a conductive member intermediary body is crimped to the cable by using the crimping metal die. In the figure, parts of the cable, the conductive member intermediary body and a lower crimping metal die are illustrated enlarged.

Referring to FIG. 13, the conductive member intermediary body 300A is pressed by the upper crimping metal die 850 and the lower crimping metal die 870 in the up-down direction under this state. The pressing causes the second portion 330A to be crimped to the conductive portion 610. Also, the pressing causes the first portion 310A to be crimped to the outer cover 630. Accordingly, the conductive member intermediary body 300A is attached with the cable 600 and results in a state shown in FIG. 8. Specifically, referring to FIGS. 5 to 11, the first portion 310A, the second portion 330A, the planar portion 350A, the coupling portion 360A, the hollow portion 365A and the bulge portion 367A become the first portion 310, the second portion 330, the planar portion 350, the coupling portion 360, the hollow portion 365 and the bulge portion 367, respectively, by the crimping operation using the upper crimping metal die 850 and the lower crimping metal die 870. In addition, the first right crimp portion 312A and the first left crimp portion 314A become the first right crimp portion 312 and the first left crimp portion 314, respectively, by the crimping operation. Further, the second right crimp portion 332A and the second left crimp portion 334A become the second right crimp portion 332 and the second left crimp portion 334, respectively, by the crimping operation. Furthermore, the ditches 370A become the ditches 370 by the crimping operation.

Figure 8:
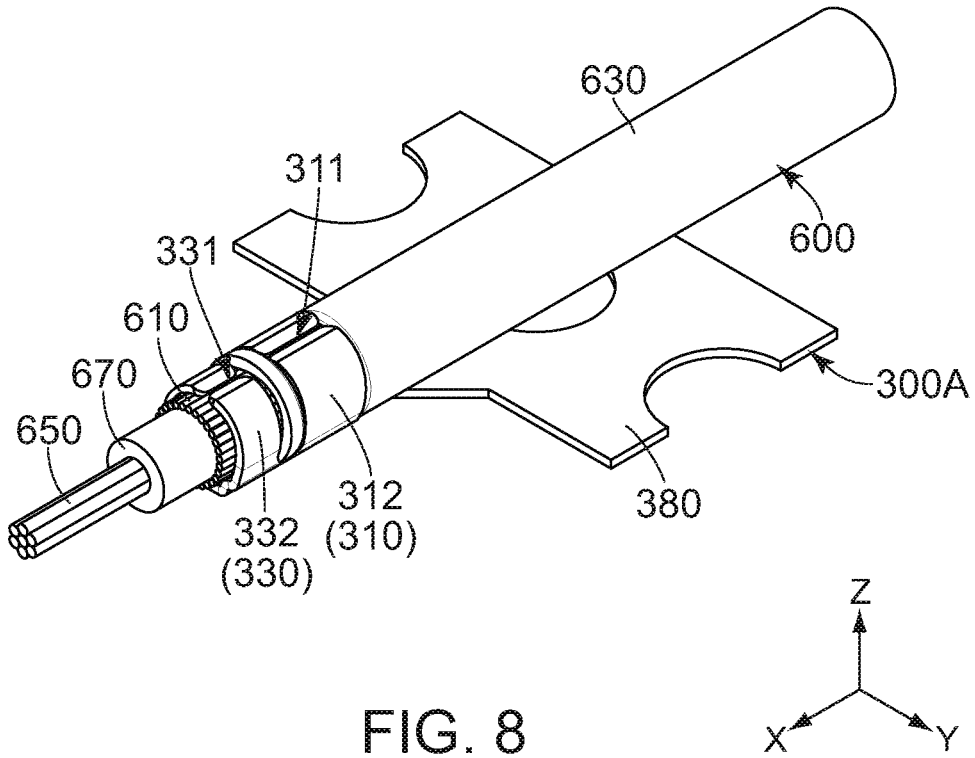
FIG. 8 is a perspective view for explaining a manufacturing process of the cable assembly of FIG. 3. In the figure, a conductive member is coupled with a carrier and is attached with a cable.

Thereafter, the conductive member 300 is formed by removing a carrier 380 shown in FIG. 8 from the conductive member intermediary body 300A, and the manufacturing of the cable assembly 100 of the present embodiment is completed.

Second Embodiment

Figure 14:
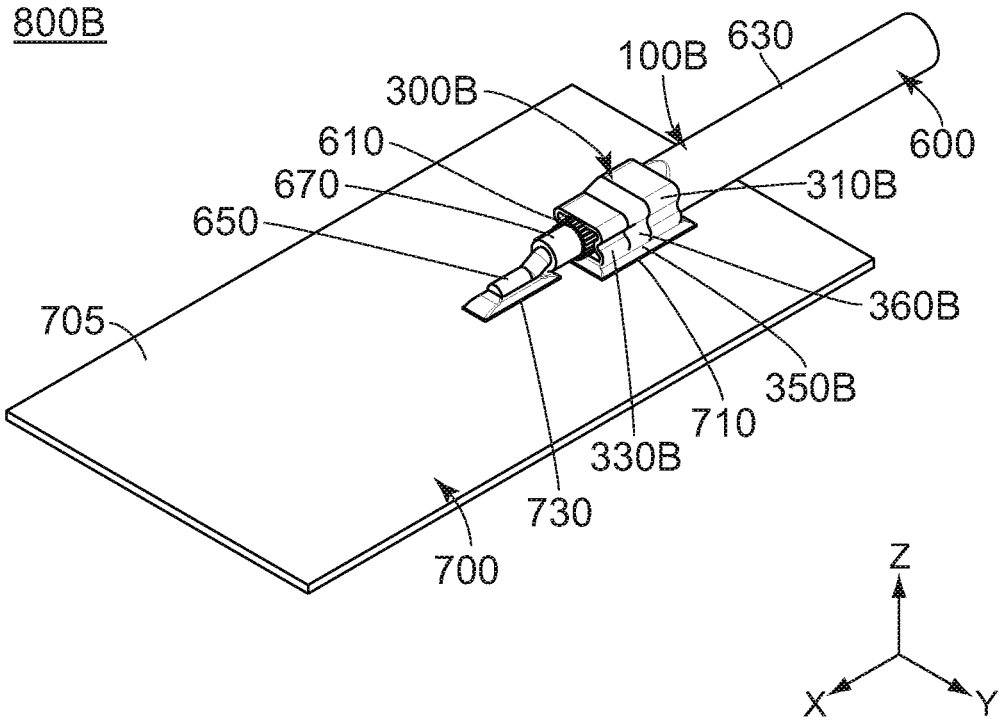
FIG. 14 is a perspective view showing a structure according to a second embodiment of the present invention. In the figure, a planar portion of a cable assembly is soldered on a fixing portion of a circuit board while a core wire of the cable assembly is soldered on a pad of the circuit board.
Figure 15:
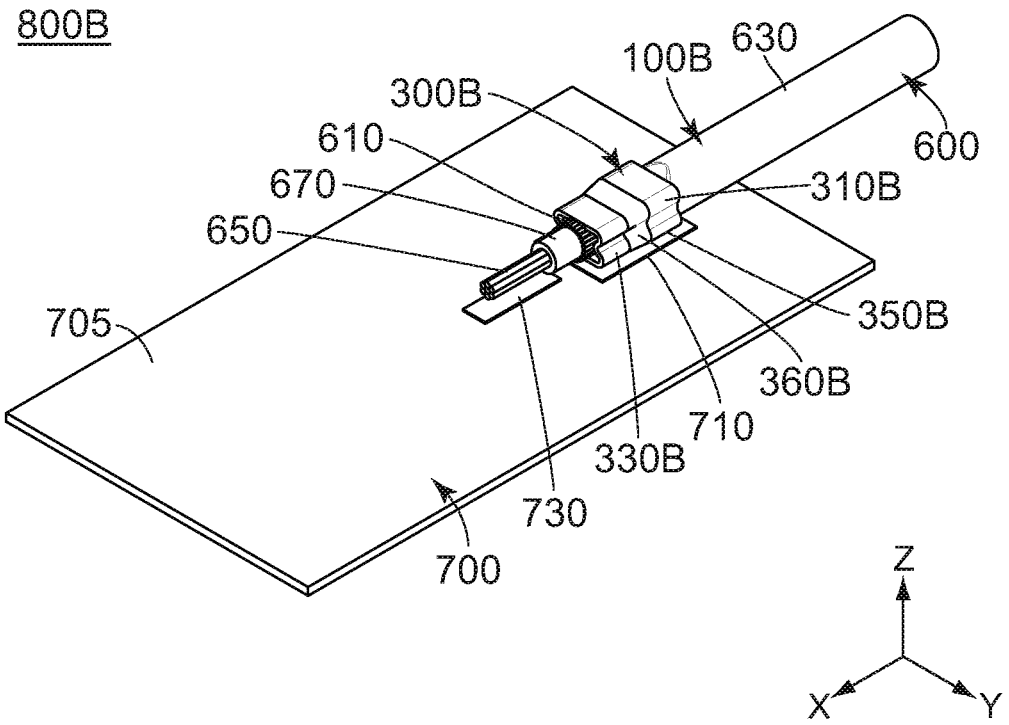
FIG. 15 is another perspective view showing the structure of FIG. 14. In the figure, the planar portion is not soldered on the fixing portion of the circuit board while the core wire is not soldered on the pad of the circuit board.

As shown in FIG. 14, a structure 800B according to a second embodiment of the present invention comprises a circuit board 700 and a cable assembly 100B. The circuit board 700 has a configuration same as that of the circuit board 700 of the aforementioned embodiment. Accordingly, a detailed explanation thereabout is omitted. As for directions and orientations in the present embodiment, expressions same as those of the first embodiment will be used hereinbelow.

Figure 16:
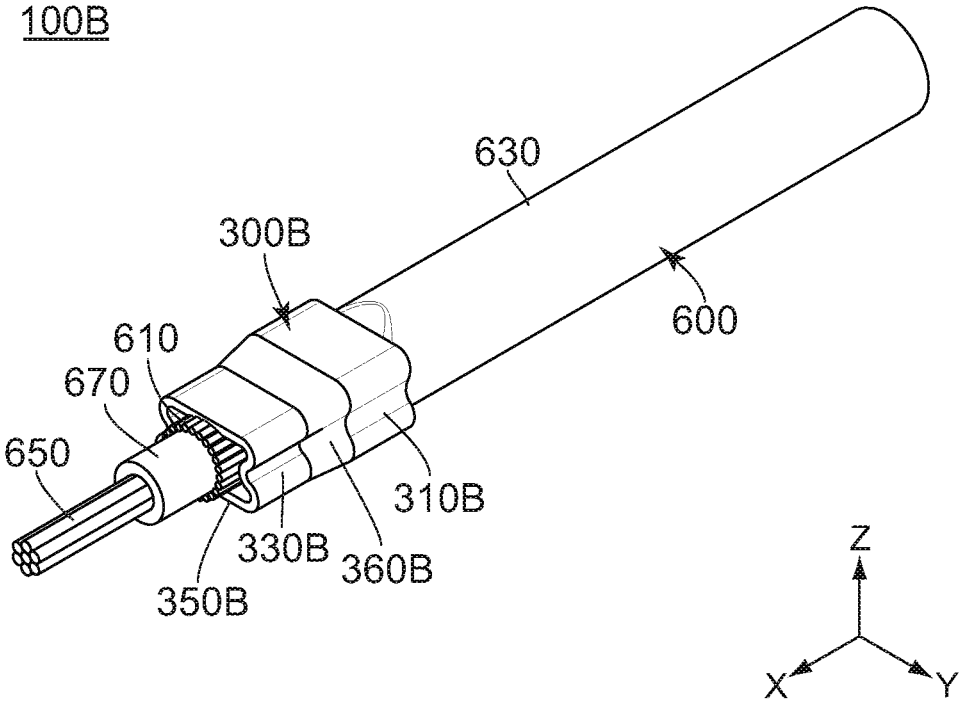
FIG. 16 is a perspective view showing the cable assembly which is included in the structure of FIG. 14.
Figure 17:
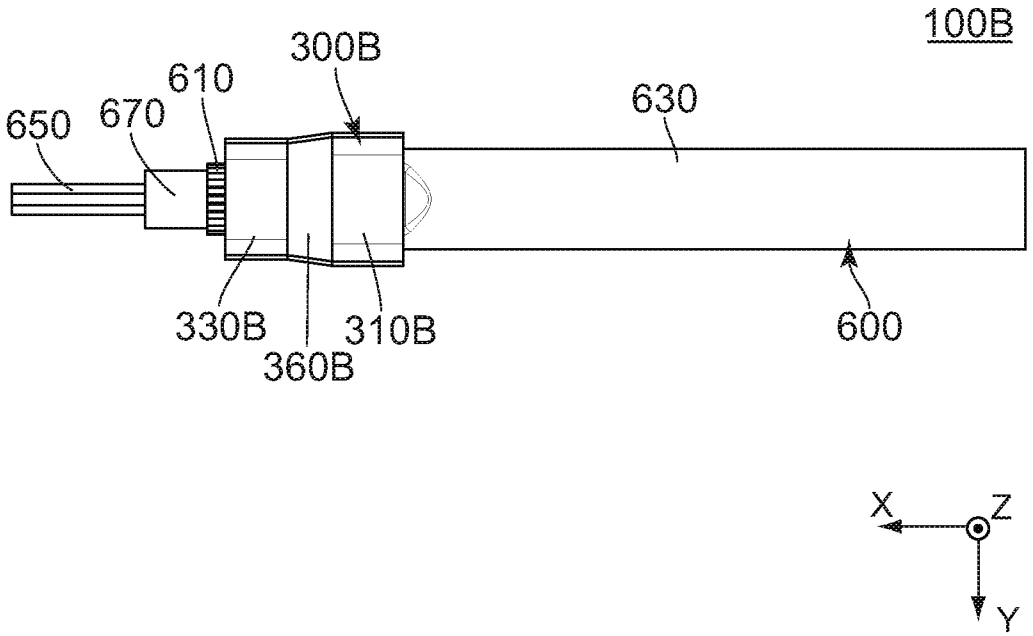
FIG. 17 is a top view showing the cable assembly of FIG. 16.

As shown in FIG. 16, the cable assembly 100B of the present embodiment comprises a cable 600 and a conductive member 300B. The cable 600 has a configuration same as that of the cable 600 of the aforementioned embodiment. Accordingly, a detailed explanation thereabout is omitted.

Figure 19:
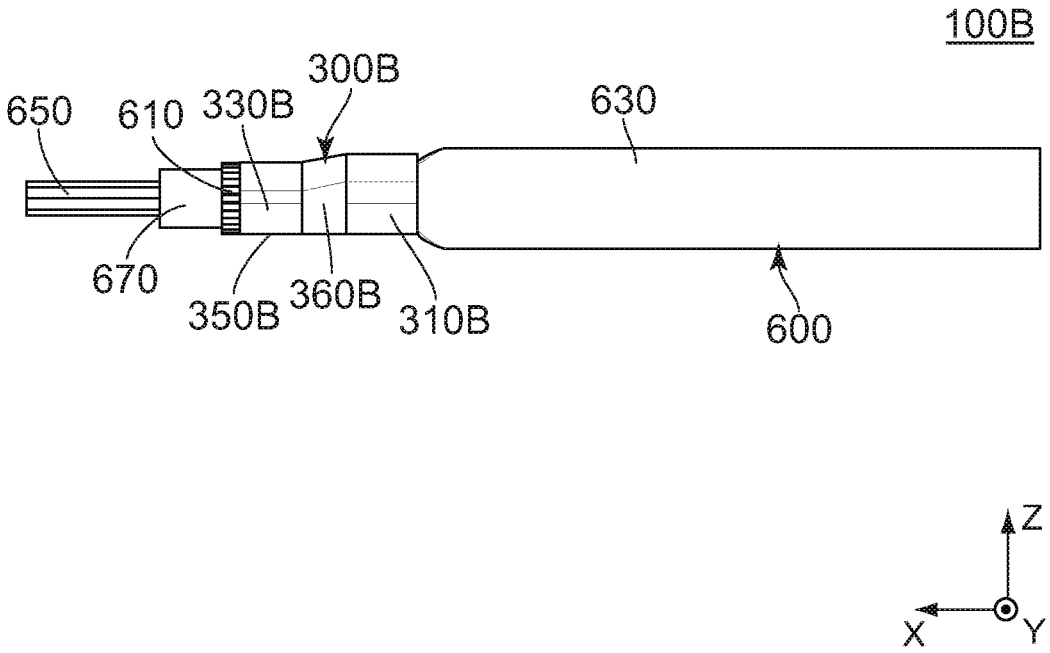
FIG. 19 is a side view showing the cable assembly of FIG. 16.
Figure 20:
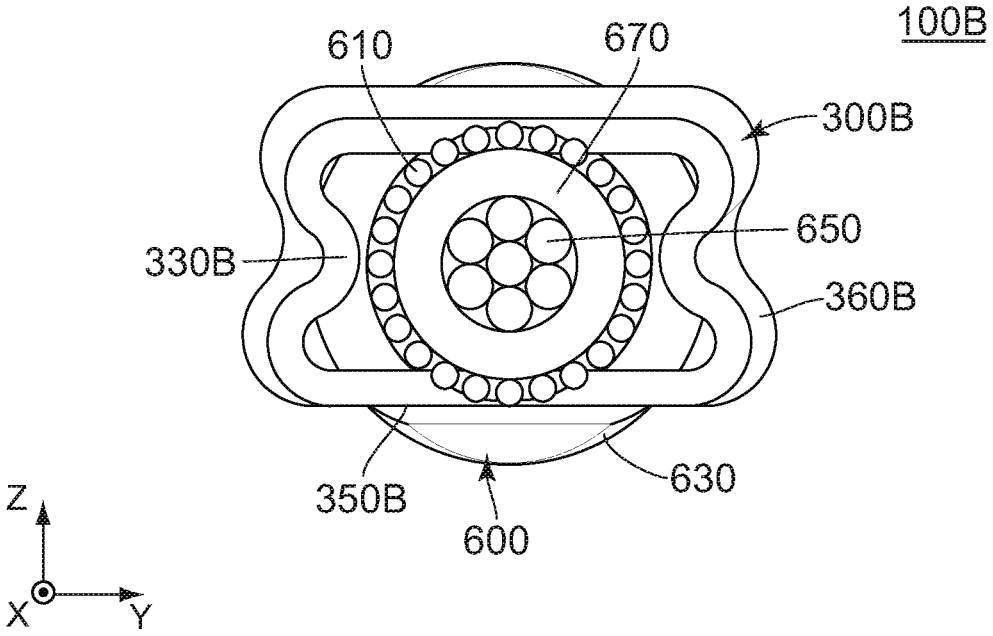
FIG. 20 is a front view showing the cable assembly of FIG. 16.

As shown in FIG. 16, the conductive member 300B of the present embodiment is attached with the cable 600. As shown in FIG. 19, the conductive member 300B has a first portion 310B, a second portion 330B, a planar portion 350B and a coupling portion 360B.

Figure 18:
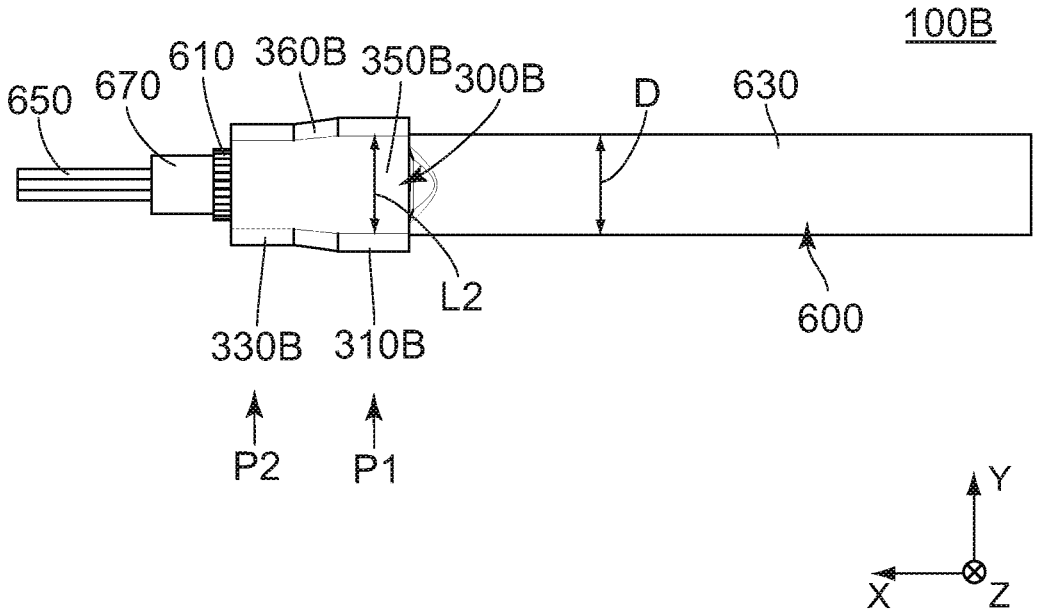
FIG. 18 is a bottom view showing the cable assembly of FIG. 16.

Referring to FIG. 16, the first portion 310B of the present embodiment has a tube shape. In other words, the first portion 310B has no hole or no cut piercing the conductive member 300B in a direction perpendicular to the longitudinal direction. The first portion 310B is crimped to an outer cover 630. As shown in FIG. 18, the first portion 310B is positioned at a first location P1 of the cable 600 in the longitudinal direction.

Referring to FIG. 16, the second portion 330B of the present embodiment has a tube shape. In other words, the second portion 330B has no hole or no cut piercing the conductive member 300B in the direction perpendicular to the longitudinal direction. The second portion 330B is crimped to a conductive portion 610. As shown in FIG. 18, the second portion 330B is positioned at a second location P2 of the cable 600 in the longitudinal direction.

As understood from FIGS. 18 and 19, the planar portion 350B of the present embodiment is a plane perpendicular to the up-down direction. The planar portion 350B defines a lower end of the conductive member 300B. The planar portion 350B extends from the first location P1 to the second location P2 in the longitudinal direction. A part of the planar portion 350B is positioned at a position same as a position of the first portion 310B in the front-rear direction. Another part of the planar portion 350B is positioned at a position same as a position of the second portion 330B in the front-rear direction. In the front-rear direction, a front end of the planar portion 350B is positioned at a position same as a position of a front end of the second portion 330B. In the front-rear direction, a rear end of the planar portion 350B is positioned at a position same as a position of a rear end of the first portion 310B.

As shown in FIG. 14, the planar portion 350B of the present embodiment is fixed on a fixing portion 710. Specifically, the planar portion 350B is fixed on the fixing portion 710 by soldering or the like. However, a method of fixing the planar portion 350B thereon is not limited to soldering. The planar portion 350B may be fixed thereon by laser welding or ultrasonic welding. If, in order to fix the cable assembly 100B of the present embodiment on the fixing portion 710 of the circuit board 700, the cable assembly 100B is placed on the circuit board 700 so that the planar portion 350B and the fixing portion 710 are brought into surface contact with each other, the cable assembly 100B never rolls on the circuit board 700. Specifically, the cable assembly 100B is prevented from being misaligned with respect to the fixing portion 710 if the cable assembly 100B is placed on the circuit board 700 so that the planar portion 350B and the fixing portion 710 are brought into surface contact with each other. In other words, the cable assembly 100B of the present embodiment has a configuration that is easy to be handled when the cable assembly 100B is fixed on the circuit board 700. As described above, the planar portion 350B of the present embodiment extends from the first location P1, where the first portion 310B is positioned, to the second location P2, where the second portion 330B is positioned, in the longitudinal direction. Thus, not only the conductive portion 610 of the cable 600 but also the outer cover 630 thereof are securely fixed on the circuit board 700 via the conductive member 300B when the planar portion 350B is fixed on the fixing portion 710. This prevents removal of the planar portion 350B of the conductive member 300B from the fixing portion 710 of the circuit board 700 even if the cable 600 of the structure 800B is swung.

Referring to FIG. 18, the planar portion 350B has a size L2 at the first location P1 in the width direction perpendicular to the longitudinal direction, and the size L2 of the planar portion 350B is half a diameter D of the cable 600 or more. This enables the cable assembly 100B to be placed stably on the circuit board 700 when the cable assembly 100B is placed on the circuit board 700 so that the planar portion 350B and the fixing portion 710 are brought into surface contact with each other.

Referring to FIG. 19, the coupling portion 360B of the present embodiment has a tube shape. In other words, the coupling portion 360B has no hole or no cut piercing the conductive member 300B in the direction perpendicular to the longitudinal direction. The coupling portion 360B is positioned between the first portion 310B and the second portion 330B in the front-rear direction. The coupling portion 360B couples the first portion 310B and the second portion 330B with each other in the front-rear direction.

Hereinafter, description will be made in detail about one example of a method of manufacturing the cable assembly 100B.

First, a conductive member intermediary body 300C, which has a cylindrical tube shape extending in the longitudinal direction, is prepared. The conductive member intermediary body 300C has a first portion 310C, a second portion 330C, a portion 350C and a coupling portion 360C.

Next, the cable 600 is threaded through the conductive member intermediary body 300C, and the outer cover 630 and an insulator 670 are partially peeled away from the cable 600 so that the conductive portion 610 and a core wire 650 are partially exposed to the outside of the cable 600. Then, the conductive member intermediary body 300C and the cable 600 result in a state shown in FIG. 22.

Figure 21:
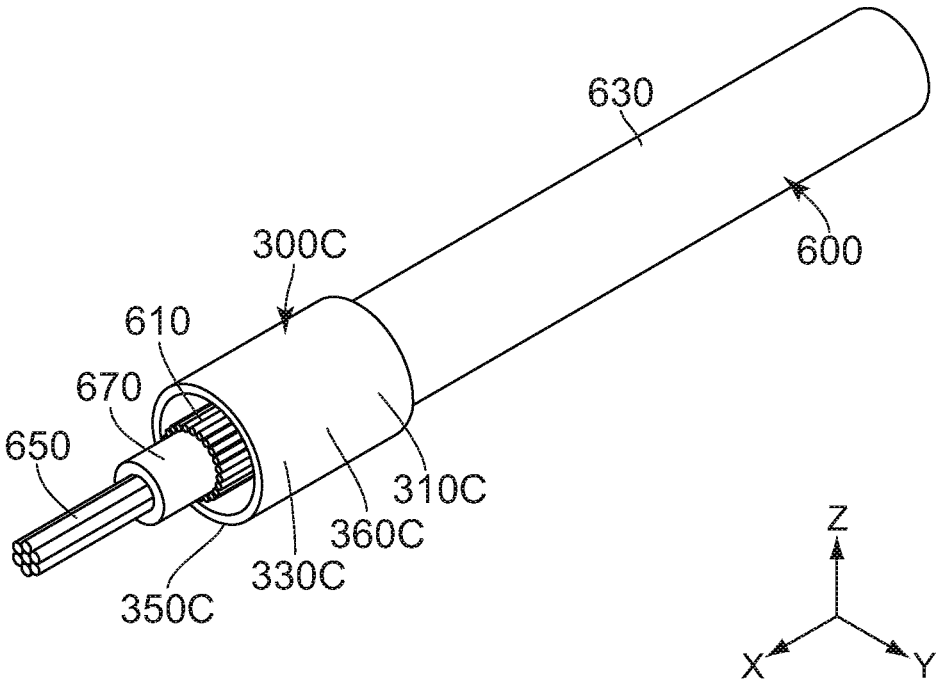
FIG. 21 is a perspective view for explaining a manufacturing process of the cable assembly of FIG. 16. In the figure, a conductive member is not attached with a cable.
Figure 22:
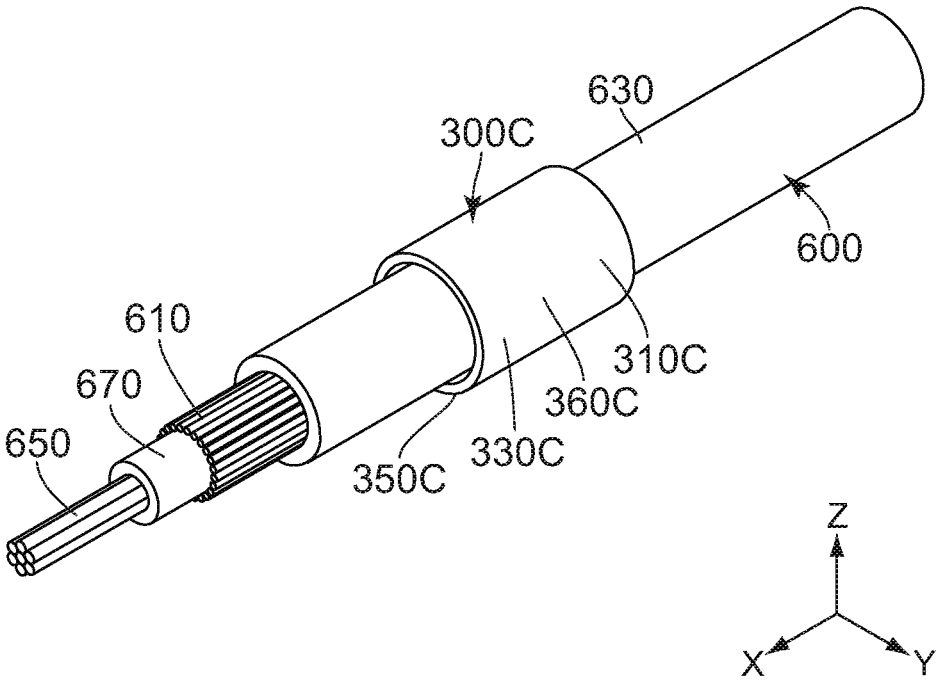
FIG. 22 is another perspective view for explaining the manufacturing process of the cable assembly of FIG. 16. In the figure, the conductive member is not attached with the cable and is positioned to surround an outer cover of the cable.
Figure 23:
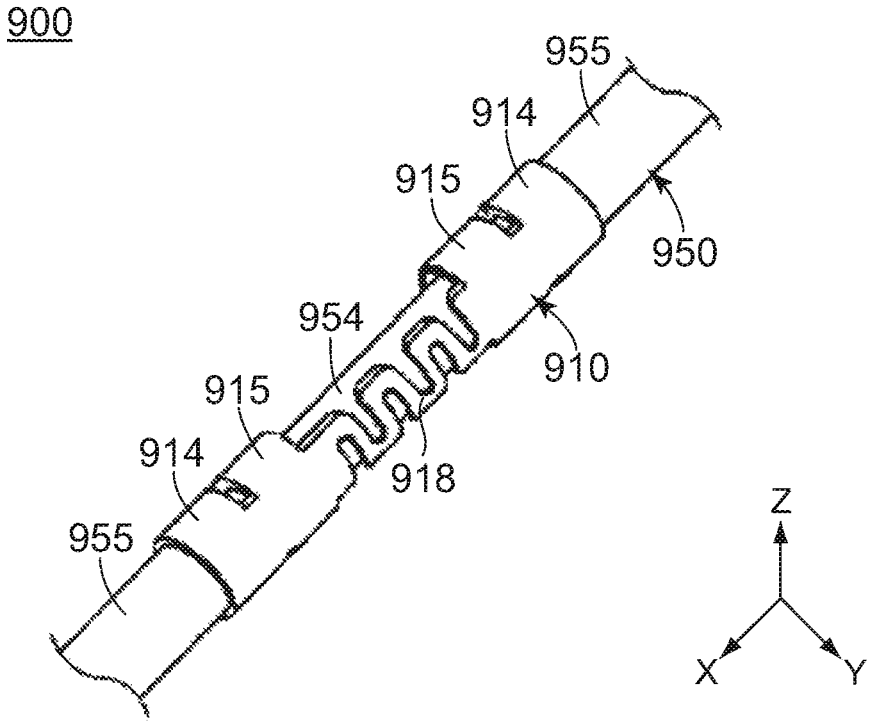
FIG. 23 PRIOR ART
FIG. 23 is a perspective view showing a cable assembly of Patent Document 1.

Starting from the state of FIG. 22, the conductive member intermediary body 300C is moved forward relative to the cable 600, and the conductive member intermediary body 300C and the cable 600 are in a state shown in FIG. 21. In this state, the first portion 310C is positioned at a position same as a position of a part of the outer cover 630 in the front-rear direction while the second portion 330C is positioned at a position same as a position of a part of the conductive portion 610 in the front-rear direction.

After that, a crimping metal die (not shown), which consists of an upper crimping metal die (not shown) and a lower crimping metal die (not shown), is prepared. The lower crimping metal die has an upper surface (not shown) which faces upward in the up-down direction.

While the conductive member intermediary body 300C and the cable 600 maintain the state of FIG. 21, the conductive member intermediary body 300C is placed on the lower crimping metal die of the crimping metal die so that the portion 350C is brought into contact with the upper surface of the lower crimping metal die. At this time, the upper crimping metal die is positioned just above the conductive member intermediary body 300C.

The conductive member intermediary body 300C is pressed by the upper crimping metal die and the lower crimping metal die in the up-down direction under this state. The pressing causes the second portion 330C to be crimped to the conductive portion 610. Also, the pressing causes the first portion 310C to be crimped to the outer cover 630. Accordingly, the conductive member intermediary body 300C and the cable 600 result in a state shown in FIG. 16, and the manufacturing of the cable assembly 100B of the present embodiment is completed. Specifically, referring to FIGS. 16 and 21, the conductive member intermediary body 300C becomes the conductive member 300B by the crimping operation using the upper crimping metal die and the lower crimping metal die. In detail, the first portion 310C, the second portion 330C, the portion 350C and the coupling portion 360C become the first portion 310B, the second portion 330B, the planar portion 350B and the coupling portion 360B by the crimping operation using the upper crimping metal die and the lower crimping metal die.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A cable assembly comprising a cable and a conductive member, wherein:

the cable extends in a longitudinal direction;

the cable has a first location and a second location in the longitudinal direction;

the cable comprises a conductive portion and an outer cover;

the outer cover covers the conductive portion;

the conductive member is attached with the cable;

the conductive member has a first portion, a second portion and a planar portion;

the first portion is positioned at the first location in the longitudinal direction;

the first portion is crimped to the outer cover;

the second portion is positioned at the second location in the longitudinal direction;

the second portion is crimped to the conductive portion;

the planar portion extends from the first location to the second location in the longitudinal direction under a state where the conductive member is attached with the cable;

the planar portion is a plane perpendicular to an up-down direction perpendicular to the longitudinal direction;

each of the first portion and the second portion has an open barrel shape;

under a state where the conductive member is not attached with the cable, the conductive member has a ditch extending in the longitudinal direction;

the ditch is positioned between the first portion and the planar portion; and the ditch is positioned between the second portion and the planar portion.

2. The cable assembly recited in claim 1, wherein:

the cable is a coaxial cable; and the conductive portion is an outer conductor.

3. The cable assembly as recited in claim 1, wherein:

the planar portion has a size at the first location in a width direction perpendicular to both the longitudinal direction and the up-down direction; and the size of the planar portion is one-tenth of a diameter of the cable or more.

4. The cable assembly as recited in claim 1, wherein:

the conductive member further has a bulge portion;

the bulge portion is bulged upward in the up-down direction;

the bulge portion is positioned at a position same as a position of the second portion in the longitudinal direction; and the bulge portion is brought into contact with the conductive portion.

5. A structure comprising a circuit board and the cable assembly as recited in claim 1, wherein:

the circuit board has a fixing portion; and the planar portion is fixed on the fixing portion.

* * * * *